United States Patent [19]

Ellison

[11] 4,436,332

[45] Mar. 13, 1984

[54] MOP HEAD INSTALLATION TOOL

[76] Inventor: Elmer L. Ellison, 1157 N. 33rd St., Springfield, Oreg. 97477

[21] Appl. No.: 289,394

[22] Filed: Aug. 3, 1981

[51] Int. Cl.[3] ..... A47L 13/25

[52] U.S. Cl. ..... 294/1 R; 15/147 B

[58] Field of Search ..... 294/1 R, 7, 25, 26, 294/92, 15, 114, 135, 136; 15/147 C, 147 B, 104–109

[56] References Cited

U.S. PATENT DOCUMENTS 2,322,046 6/1943 Miller ..... 294/1 R

FOREIGN PATENT DOCUMENTS 1604448 5/1978 United Kingdom ..... 15/147 B

*Primary Examiner*—James B. Marbert

*Attorney, Agent, or Firm*—James D. Givnan, Jr.

[57] ABSTRACT

A hand tool provided with a handgrip at its upper end which is integral with a guide portion of semi-circular cross section. The semi-circular guide portion is adapted to slidably receive the rounded end of a mop frame during mop head attachment to the frame. A lip at the lower end of the guide portion is insertably engageable with a fabric pocket on the mop head to facilitate stretching of the mop head by the tool during mop head installation on the frame.

2 Claims, 7 Drawing Figures

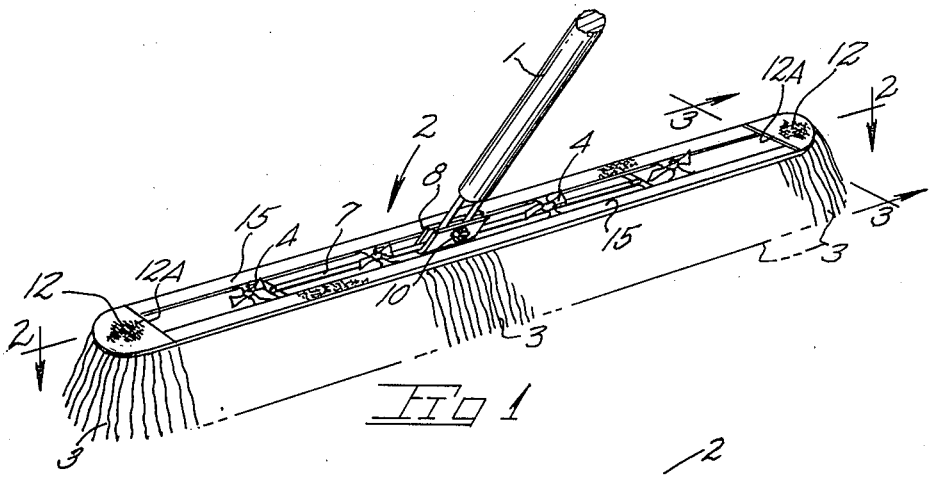
FIG. 1
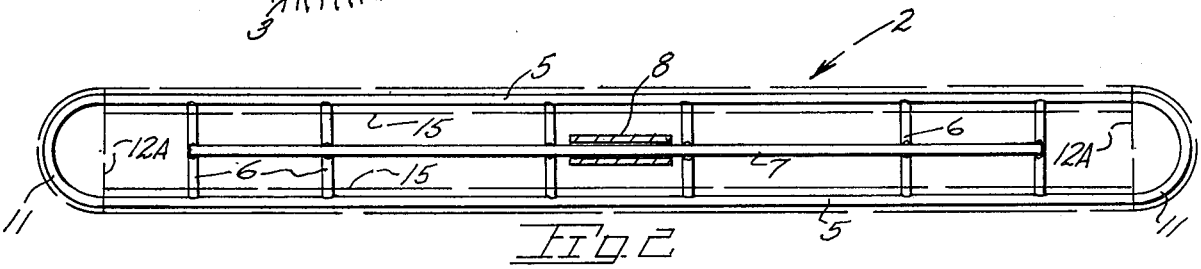
FIG. 2
FIG. 3
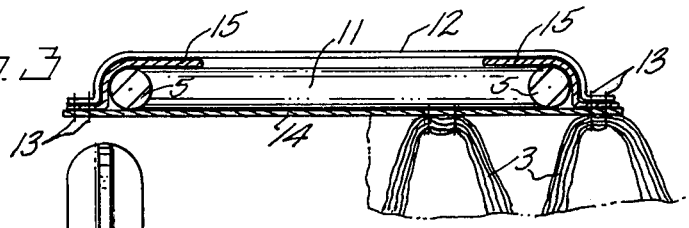
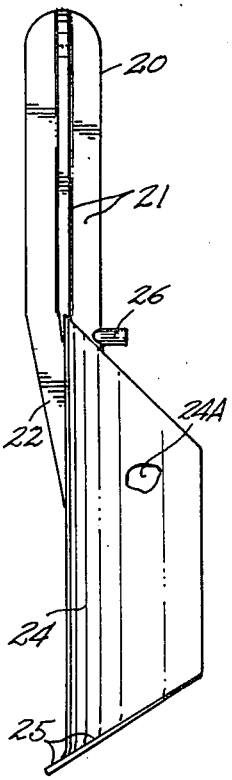
FIG. 4
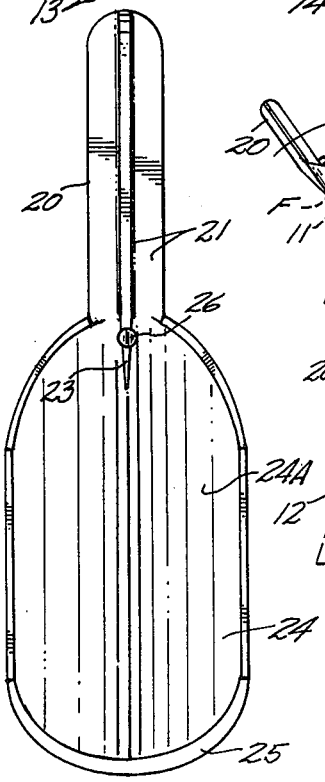
FIG. 5
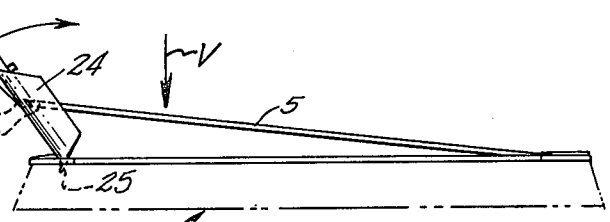
FIG. 6
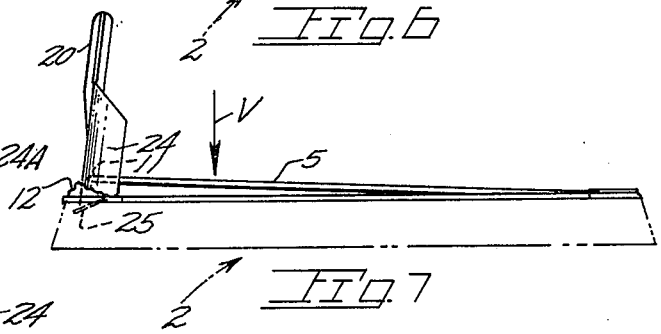
FIG. 7

MOP HEAD INSTALLATION TOOL

BACKGROUND OF THE INVENTION

The present invention relates generally to mops of the type used in industrial or commercial buildings which mops are typically removably mounted on an elongate wire frame.

The mop heads are constructed from heavy canvas panels to the lowermost of which are secured the mop fibres. The remaining panels are adapted to overlie the wire members of the mop frame. Securement of the mop head to the frame is customarily by ties with the frame ends in inserted engagement with overlying fabric end pieces of the mop head.

Mounting of a mop head on a frame entails stretching of the head to effect passage of an end piece over the exposed frame end. Such a task is time consuming and often results in broken fingernails. Further, the mop head may be damaged during tugging on one end of same in this stretching operation.

SUMMARY OF THE PRESENT INVENTION

The present invention is embodied in a hand tool for inserted engagement with a mop head to temporarily stretch same and simultaneously guide into place one end of a mop frame.

Briefly, the tool includes a handgrip of sturdy design integral with which is a guide along which the mop frame end may slide into inserted engagement with the end of a mop head. Means are provided on the guide to facilitate retention of the tool in place on the mop during mop head installation. A surface on the guide is slidably engaged by the mop frame end. Slight manual pressure exerted downwardly on the mop frame seats the frame into inserted engagement with the temporarily stretched mop head.

Important objectives of the present invention include the provision of a tool of unitary nature which may act about one end of an elongate mop frame to stretch a mop head and thereafter serves to guide the mop frame into place therewithin; the provision of a tool providing adequate leverage for mop head stretching to permit convenient mop head installation by those having low arm and hand strength; the provision of a tool lending itself to mass production methods and hence low production cost. Other objectives will become subsequently apparent.

BRIEF DESCRIPTION OF THE DRAWING

In the drawing:

FIG. 1 is a perspective view of a mop head in place on a mop frame with the handle broken away for purposes of illustration;

FIG. 2 is a view taken along line 2—2 of FIG. 1 with the mop head shown in phantom lines;

FIG. 3 is a vertical sectional view taken along line 3—3 of FIG. 1;

FIGS. 4 and 5 are side and front elevational view respectively of the present tool; and FIGS. 6 and 7 illustrate tool use with the tool shown in side elevation on a greatly reduced scale.

DETAILED DESCRIPTION OF THE PREFERRED EMBODIMENT

With continuing attention to the drawing, the reference numeral 1 indicates the handle of an industrial mop having a mop head generally at 2 comprised of sewn heavy duck panels and an absorbent mass of fibrous material at 3. Typically the mop head is mounted on a wire frame in an encompassing manner with ties at 4 tied transversely over the elongate wire members of the mop frame. Said frame is of rigid construction with a closed main frame member at 5 (FIG. 2) reinforced therealong by cross members 6. A central frame member 7 of lesser length serves to swingably receive a fitting 8 to which is fastened at 10 the lower end of mop handle 1.

Of particular interest are the mop frame ends at 11 which are of semi-circular shape and intended for inserted engagement with pockets formed in the mop head ends. For purposes of mop head to mop frame securement, pockets are formed with overlying fabric end members at 12. Per FIG. 3, the fabric members 12 are stitched by stitch lines 13 to a fabric base member 14 of the mop, the latter member carrying the absorbent fibrous material. Extending lengthwise along each upper side of the mop head are fabric strips 15 also held in place by stitching 13 but which have free inner edges to permit overlying placement on the perimeter of closed mop frame member 5. The ties are carried by strips 15. The foregoing is intended to be a more or less typical description of mop heads and frames as currently used in industrial, educational and commercial buildings.

Mop head installation heretofore entailed lengthwise manual stretching of the fabric mop head and the manipulation of the mop head 2 over the frame ends. A problem arises in installing the second attached pocket shaped end of the mop head over the frame end as mop heads are dimensioned lengthwise for a close fit with the mop frame.

The present tool includes a handgrip 20 preferably having reinforcing webs at 21 providing a handle of cruciform shape in section. Handle extensions 22, 23 provide reinforcing ribs which extend downwardly into a guide portion 24 of the tool. Said guide portion is a shape to receive a rounded or semi-circular end 11 of a mop frame. An inner surface 24A of the guide slidably receives the frame end as shown in FIGS. 6 and 7. A stop 26 on the tool restricts upward sliding travel of the frame.

The lower end of guide portion 24 terminates in inclined relationship to the tool major axis to receive retention means 25 shown as a lip which is insertable during tool use into a mop head pocket beneath a fabric end member 12. More precisely, lip 25 is positionable below the inner edge 12A of an end member and also beneath those segments of fabric strips 15 proximate edge 12A. The following description assumes the other ends of the mop frame and mop head have already been insertably engaged which, of course, is accomplished without stretching of the mop head. As viewed in the front elevational view of FIG. 5, the guide provides a concave wall surface against which the rounded end of the mop frame may be placed in an abutting manner. With continuing reference to FIG. 6, hand pressure exerted lightly downward along vector V permits the frame end 11 to serve as a fulcrum F for tool positioning per the applied arrow. During such rotational positioning of the tool the mop head is stretched in a lengthwise direction. The tool, upon moving past the vertical to the FIG. 7 position, causes the frame to automatically position itself downwardly into place below the momentarily displaced end of the mop head.

The tools may be made with a semi-circular shaped guide (in section) with diameters of three or five inches or thereabouts to accommodate mop frames of three and five inch widths as now currently used by mop manufacturers.

For low cost of manufacture the present tool is of molded construction of a strong plastic with a guide wall thickness of about five thirty-seconds of an inch and overall tool length of about ten inches.

While I have shown but one embodiment of the invention it will be apparent to those skilled in the art that the invention may be embodied still otherwise without departing from the spirit and scope of the invention.

Having thus described the invention, what is desired to be secured under a Letters Patent is:

I claim:

1. A hand held tool for temporary engagement with and manually stretching fabric mop heads during installation of same on elongate mop frames, said tool comprising, a handgrip, and a guide structure of semi-circular section integral with one end of said handgrip, said guide structure including a lip remote from the handgrip and adapted for temporary inserted engagement with one end of a mop head, said guide structure including a curved surface area along which one end of the mop frame may slide into inserted engagement with that portion of the mop head temporarily engaged by said lip of the guide structure.

2. The tool claimed in claim 1 wherein said guide structure includes a stop to limit travel of a mop frame end during mop head installation.

* * * * *